US008428499B2

(12) United States Patent
Shinshi

(10) Patent No.: US 8,428,499 B2
(45) Date of Patent: Apr. 23, 2013

(54) IMAGE FORMING APPARATUS, AND FIXING APPARATUS HAVING A HEATING MEMBER TO HEAT A FIXING MEMBER

(75) Inventor: Akira Shinshi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 494 days.

(21) Appl. No.: 12/153,632

(22) Filed: May 22, 2008

(65) Prior Publication Data

US 2008/0298862 A1 Dec. 4, 2008

(30) Foreign Application Priority Data

May 22, 2007 (JP) ..... 2007-135044
Feb. 26, 2008 (JP) ..... 2008-044643

(51) Int. Cl.
*G03G 15/20* (2006.01)
*G03G 15/08* (2006.01)

(52) U.S. Cl.
USPC ..... 399/329; 399/122

(58) Field of Classification Search ..... 399/329, 399/122
See application file for complete search history.

(56) References Cited

U.S. PATENT DOCUMENTS 5,499,087 A * 3/1996 Hiraoka et al. ..... 399/329
6,882,820 B2 4/2005 Shinshi et al.
7,127,204 B2 10/2006 Satoh et al.
7,239,838 B2 7/2007 Sato et al.
7,242,897 B2 7/2007 Satoh et al.
7,313,353 B2 12/2007 Satoh et al.
7,330,682 B2 2/2008 Shinshi
2001/0032835 A1* 10/2001 Murooka et al. ..... 219/216
2003/0170054 A1* 9/2003 Suzuki et al. ..... 399/328
2004/0013453 A1 1/2004 Shinshi et al.
2005/0147436 A1* 7/2005 Koyama et al. ..... 399/329
2005/0163543 A1 7/2005 Satoh et al.
2006/0002737 A1 1/2006 Shinshi
2006/0116230 A1 6/2006 Satoh et al.
2006/0165429 A1 7/2006 Satoh et al.
(Continued)

FOREIGN PATENT DOCUMENTS

JP 04156576 A * 5/1992
JP 11-002982 1/1999
(Continued)

OTHER PUBLICATIONS

Notice of Rejection for corresponding Japanese patent application No. 2008-044643 dated Apr. 4, 2012.

*Primary Examiner* — Walter L Lindsay, Jr.
*Assistant Examiner* — Billy J Lactaoen
(74) *Attorney, Agent, or Firm* — Harness, Dickey & Pierce, P.L.C.

(57) ABSTRACT

A fixing apparatus includes a flexible endless fixing member that moves in a predetermined direction for heating and melting a toner image, a heating member that is fixed to the fixing member in a position facing at least a part of an inner peripheral surface of the fixing member for heating the fixing member, and a pressing member that provides a nipping part by pressing into contact with the fixing member for conveying a recording medium. The heating member includes a metal plate subjected to a bending process.

21 Claims, 7 Drawing Sheets

U.S. PATENT DOCUMENTS

| | | | | |
|---|---|---|---|---|
| 2006/0177251 | A1* | 8/2006 | Uehara et al. | 399/329 |
| 2007/0003334 | A1 | 1/2007 | Shinshi et al. | |
| 2007/0014603 | A1 | 1/2007 | Satoh et al. | |
| 2007/0059003 | A1 | 3/2007 | Shinshi et al. | |
| 2007/0059071 | A1 | 3/2007 | Shinshi et al. | |
| 2007/0110464 | A1 | 5/2007 | Nakayama et al. | |
| 2007/0166085 | A1 | 7/2007 | Shinshi | |
| 2007/0292175 | A1 | 12/2007 | Shinshi | |
| 2008/0232871 | A1* | 9/2008 | Jung et al. | 399/329 |

FOREIGN PATENT DOCUMENTS

| | | | |
|---|---|---|---|
| JP | 11-231702 | | 8/1999 |
| JP | 2001-228731 | | 8/2001 |
| JP | 2002-006656 | | 1/2002 |
| JP | 2004-191514 | | 7/2004 |
| JP | 2005-092080 | | 4/2005 |
| JP | 2006-251068 | | 9/2006 |
| JP | 2006251069 | A * | 9/2006 |

* cited by examiner

IMAGE FORMING APPARATUS, AND FIXING APPARATUS HAVING A HEATING MEMBER TO HEAT A FIXING MEMBER

BACKGROUND OF THE INVENTION

1. Field of the Invention

The present invention relates to an image forming apparatus (e.g., a copier, a printer, a facsimile machine, a multifunction machine), a fixing apparatus and a heating member that are mounted in the image forming apparatus.

2. Description of the Related Art

Conventionally, there is a known method in which a fixing belt, spanning across plural roller members, is used as a fixing member in an image forming apparatus (e.g., copier, printer) (for example, see Japanese Laid-Open Patent Application No. 11-2982). This type of image forming apparatus includes, for example, a fixing belt (endless belt) used as a fixing member, plural roller members around and between which the fixing belt spans, a heater installed in one of the plural roller members, and a pressure roller (pressing member). The heater heats the fixing belt via its corresponding roller member. Then, a recording medium is conveyed to a nipping part between the fixing belt and the pressure roller, so that a toner image can be fixed onto the recording medium by heat and pressure applied at the nipping part.

Another fixing apparatus (on-demand type fixing apparatus) requiring a short warm-up time is disclosed in Japanese Laid-Open Patent Application No. 2002-6656. The on-demand type fixing apparatus includes, for example, a fixing film (endless film) used as a fixing member, a pressure roller (pressing member), and a heater (e.g., ceramic heater). The ceramic heater is installed in the fixing film. The ceramic heater forms a nipping part by contacting the pressure roller via the fixing film. The ceramic heater is configured to heat the fixing film. Accordingly, a recording medium is conveyed to the nipping part, so that a toner image can be fixed onto the recording medium by heat and pressure applied at the nipping part.

Although the fixing apparatus of Japanese Laid-Open Patent Application No. 11-2982 may be suitable for realizing faster operations compared to an apparatus using a fixing roller, this fixing apparatus has limits in shortening a warm-up time (time required for reaching a temperature for performing a printing operation) or a first print time (time required for preparing and performing a printing operation starting from receipt of a print request and ending when a printed paper is discharged).

On the other hand, the fixing apparatus disclosed in Japanese Laid-Open Patent Application No. 2002-6656 enables shortening of the warm-up time and the first print time due to its reduced heat capacity. Furthermore, size reduction can be realized with this fixing apparatus. However, because this fixing apparatus locally heats the nipping part of the fixing film only, areas other than the fixing film are not sufficiently heated. Thus, the rotation of the fixing film causes the fixing film to become coldest at the mouth of the nipping part. This leads to poor fixing results. With this fixing apparatus, more heat is released from the fixing film at areas other than the nipping part as the rotation of the fixing film becomes faster.

In order to resolve the above-described problems, there is a method of providing a pipe-like heating member formed of a thermally conductive material in a manner facing an inner peripheral surface of an endless fixing member (e.g., endless fixing belt, endless fixing film), so that the entire fixing member can be uniformly and sufficiently heated by directly or indirectly heating the heating member.

In order to improve the heating efficiency of the fixing member, it is desired to make the pipe-like heating member (thermally conductive metal material) as thin as possible. However, there are limits in precisely fabricating such a thin pipe-like heating member by a cutting process. For example, the rigidity of the heating member may decrease as the cutting process progresses. The heating member having such a decreased rigidity may be deformed by the chucking force applied by a processing machine or bent during a cutting process. This makes it difficult to fabricate the heating member with a uniform thickness.

Particularly, in a case where an area of the heating member corresponding to the nipping part is formed in a flat shape or a recessed shape for improving the property of separating a recording medium delivered from the nipping part, it is difficult to perform a precise cutting process on the heating member. In forming the area in a flat or recessed shape, it is also necessary to perform subsequent additional processes on the heating member. This results in an increase of manufacturing costs. In other words, fabricating a precise inexpensive heating member becomes more difficult as the heating member becomes thinner.

SUMMARY OF THE INVENTION

The present invention may provide an image forming apparatus, a fixing apparatus and a heating member that substantially obviates one or more of the problems caused by the limitations and disadvantages of the related art.

Features and advantages of the present invention are set forth in the description which follows, and in part will become apparent from the description and the accompanying drawings, or may be learned by practice of the invention according to the teachings provided in the description. Objects as well as other features and advantages of the present invention will be realized and attained by an image forming apparatus, a fixing apparatus and a heating member particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the present invention provides a fixing apparatus including a flexible endless fixing member that moves in a predetermined direction for heating and melting a toner image; a heating member that is fixed to the fixing member in a position facing at least a part of an inner peripheral surface of the fixing member for heating the fixing member; and a pressing member that provides a nipping part by pressing into contact with the fixing member for conveying a recording medium; wherein the heating member includes a metal plate subjected to a bending process.

Furthermore, another embodiment of the present invention provides an image forming apparatus including the fixing apparatus according to the embodiment of the present invention.

Furthermore, another embodiment of the present invention provides a heating member including a metal plate configured to be fixed to a flexible endless fixing member in a position facing an inner peripheral surface of the fixing member for heating the fixing member; wherein the metal plate is subjected to a bending process.

Other objects, features and advantages of the present invention will become more apparent from the following detailed description when read in conjunction with the accompanying drawings.

DETAILED DESCRIPTION OF THE PREFERRED EMBODIMENTS

In the following, embodiments of the present invention will be described with reference to the accompanying drawings.

First Embodiment

First, an overall configuration and operation of an image forming apparatus 1 according to an embodiment of the present invention are described with reference to FIG. 1.

Figure 1:
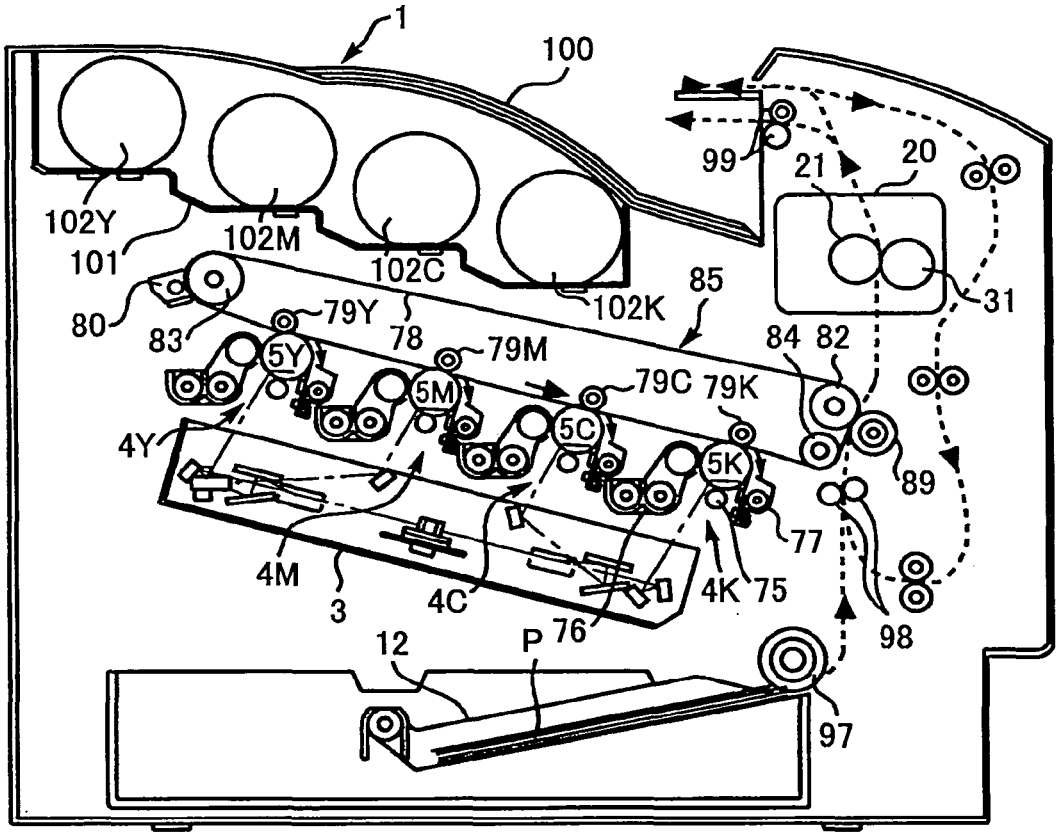
FIG. 1 is a schematic diagram showing an image forming apparatus according to an embodiment of the present invention.

As shown in FIG. 1, the image forming apparatus 1 according to an embodiment of the present invention is a tandem type color printer. Four replaceable toner bottles 102Y, 102M, 102C, and 102K corresponding to the colors of yellow, magenta, cyan, and black are detachably attached to a bottle installing part 101 situated at an upper part of a main body 100 of the image forming apparatus 1.

An intermediate transfer unit 85 having an intermediate transfer belt 78 is positioned below the bottle installing part 101. Image forming parts 4Y, 4M, 4C, and 4K corresponding to the colors of yellow, magenta, cyan, and black are aligned in a manner facing the intermediate transfer belt 78.

Each of the image forming parts 4Y, 4M, 4C, and 4K has a corresponding photoconductor drum 5Y, 5M, 5C, and 5K. Each photoconductor drum 5Y, 5M, 5C, and 5K is surrounded by a charging part 75, a developing part 76, a cleaning part 77, and a charge removing part (not shown). By performing an image forming process (including a charging step, a exposing step, a developing step, a transferring step, and a cleaning step) on each photoconductor drum 5Y, 5M, 5C, 5K, an image of a corresponding color is formed on the surface of each photoconductor drum 5Y, 5M, 5C, 5K.

Each photoconductor drum 5Y, 5M, 5C, 5K is rotated (in a clockwise direction in FIG. 1) by a driving motor (not shown). The surfaces of the photoconductor drums 5Y, 5M, 5C, 5K are uniformly charged by corresponding charging parts 76 (charging step).

Then, an electrostatic latent image of a corresponding color is formed on the charged surface of each photoconductor drum 5Y, 5M, 5C, 5K by irradiating a laser beam L from an exposing part 3 and scanning (exposing) the surface with the laser beam L (exposing step).

Then, the electrostatic latent image formed on the surface of each photoconductor drum 5Y, 5M, 5C, 5K is developed at a position facing corresponding developing part 76, to thereby form a toner image for each color (developing step).

Then, the toner image formed on each photoconductor drum 5Y, 5M, 5C, 5K is transferred to an intermediate transfer belt 78 at a position where the intermediate transfer belt 78 and corresponding first transfer bias roller 79Y, 79M, 79C, 79K face each other (first transferring step). When the toner images are transferred to the intermediate transfer belt 78, some untransferred toner remains on the surfaces of the photoconductor drums 5Y, 5M, 5C, 5K.

Then, toner particles remaining on the surfaces of the photoconductor drums 5Y, 5M, 5C, 5K are mechanically removed by a cleaning blade of corresponding cleaning parts 77 at positions where the photoconductor drums 5Y, 5M, 5C, 5K face the corresponding cleaning parts 77 (cleaning step).

Then, residual charges remaining on the surfaces of the photoconductor drums 5Y, 5M, 5C, 5K are removed at positions where the photoconductor drums 5Y, 5M, 5C, 5K face corresponding charge removing parts (not shown).

By performing these series of steps on the photoconductor drums 5Y, 5M, 5C, 5K, the image forming process is completed.

As described above, a color image is formed on the intermediate transfer belt 78 by superposing the toner images formed on the surfaces of each of the photoconductor drums 5Y, 5M, 5C, 5K on the surface of the intermediate transfer belt 78.

In addition to the intermediate transfer belt 78, the intermediate transfer unit 85 also includes, for example, the four first transfer bias rollers 79Y, 79M, 79C, 79K, a second transfer backup roller 82, a cleaning backup roller 83, a tension roller 84, and an intermediate transfer cleaning part 80. The intermediate transfer belt 78 spans across three rollers 82-84, and is driven by the roller 82, so that the intermediate transfer belt 78 is rotated in an endless manner in the arrow direction illustrated in FIG. 1.

The four first transfer bias rollers 79Y, 79M, 79C, 79K and the corresponding photoconductor drums 5Y, 5M, 5C, 5K are positioned to provide corresponding first transfer nipping portions at which the intermediate transfer belt 78 is nipped between the first transfer bias rollers 79Y, 79M, 79C, 79K and the photoconductor drums 5Y, 5M, 5C, 5K.

Accordingly, the intermediate transfer belt 78 being rotated in the arrow direction successively passes through the first transfer nipping portions corresponding to the first transfer bias rollers 79Y, 79M, 79C, 79K. Thereby, the toner images of each color formed on the surfaces of the corresponding photoconductor drums 5Y, 5M, 5C, 5K are transferred onto the intermediate transfer belt 78 in a superposed manner (first transfer).

Then, the superposed toner images transferred to the intermediate transfer belt 78 are conveyed to a position facing a second transfer roller 89. At this position, the second transfer backup roller 82 and the second transfer roller 89 are positioned to provide a second transfer nipping portion at which the intermediate transfer belt 78 is nipped between the second transfer backup roller 82 and the second transfer roller 89. Then, the four color toner images superposed on the intermediate transfer belt 78 are transferred to a recording medium P conveyed to the position of the second transfer nipping portion. When the toner images are transferred to the recording medium P, some untransferred toner remains on the surface of the intermediate transfer belt 78.

Then, when the intermediate transfer belt 78 reaches a position facing an intermediate transfer cleaning part 80, the toner remaining on the surface of the intermediate transfer belt 78 is removed.

By performing theses series of steps on the intermediate transfer belt, the transferring process is completed.

The recording medium P, which is conveyed to the second transfer nipping portion, is conveyed from a sheet feeding portion 12 positioned at a lower part of the main body 100 of the image forming apparatus 1 via, for example, a sheet feeding roller 97 and a pair of resist rollers 98.

More specifically, plural recording media (e.g., transfer papers) are stacked inside the sheet feeding portion 12. When the sheet feeding roller 97 is rotated in a counter-clockwise direction shown in FIG. 1, the recording medium P on the top of the stack is fed toward the pair of resist rollers 98.

Then, the recording medium P conveyed from the sheet feeding portion 12 temporarily stops upon reaching the position of the resist rollers 98 which are not rotating.

The rotation of the resist rollers 98 is started at a predetermined timing corresponding to the color image conveyed on the intermediate transfer belt 78. The recording medium P is conveyed to the second transfer nipping portion by rotating the resist rollers 98. Thereby, the superposed 4-color image is transferred onto the recording medium P.

Then, the recording medium P is conveyed to a position of a fixing part 20. At this position, pressure and heat are applied from a fixing belt 21 and a pressure roller 31 to the recording medium P. Thereby, the color image transferred onto the recording medium P is fixed to the recording medium P.

Then, the recording medium P is discharged from the image forming apparatus 100 via a pair of discharge rollers 99. The recording medium P is discharged as an output image onto a stacking part of the upper part of the main body 100 that allows plural recording media P to be successively stacked thereon.

By performing the above-described series of steps, an image forming operation is completed.

Figure 2:
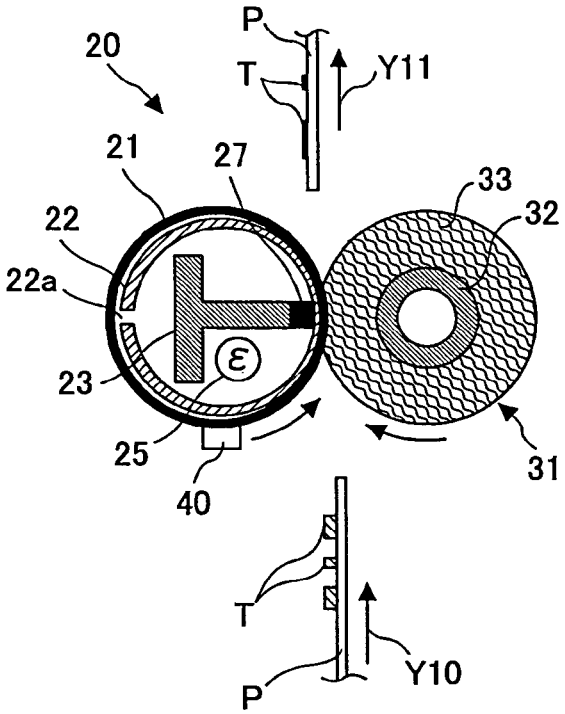
FIG. 2 is a schematic diagram showing a fixing apparatus included in an image forming apparatus according to a first embodiment of the present invention.
Figure 3:
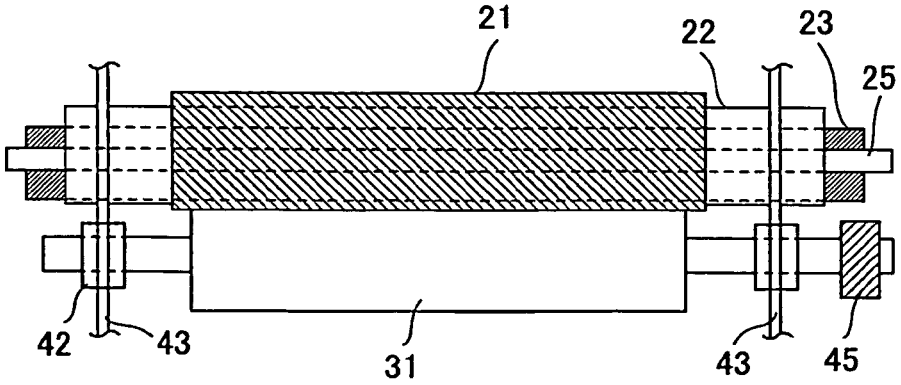
FIG. 3 is a schematic diagram of a fixing apparatus observed in its width direction according to an embodiment of the present invention.
Figure 4:
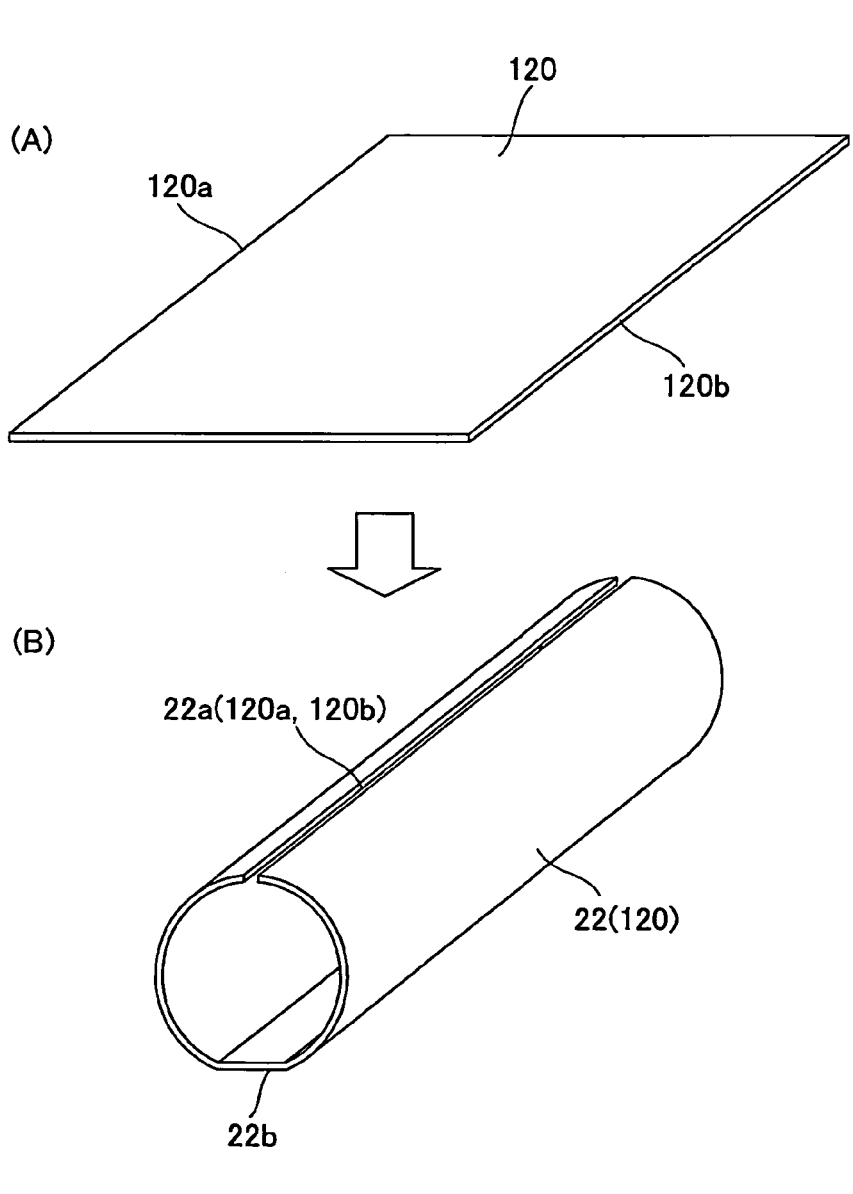
FIG. 4 is a schematic diagram for describing a process of manufacturing a heating member according to an embodiment of the present invention.

FIG. 2 is a schematic diagram showing a fixing apparatus 20 according to an embodiment of the present invention. FIG. 3 is a schematic diagram of the fixing apparatus 20 observed in its width direction. FIG. 4 is a schematic diagram for describing a process of manufacturing a heating member 22 to be provided in the fixing apparatus 20. As shown in FIG. 2, the fixing apparatus 20 includes, for example, a fixing belt (fixing member) 21, the heating member 22, a reinforcing member 23, a heat insulating member 27, a heater (heat source) 25, a pressure roller (pressing member) 31, and a temperature sensor 40.

In this embodiment of the present invention, the fixing belt 21 is a thin flexible endless belt which rotates (travels) in a counter-clockwise direction (illustrated with an arrow in FIG. 2). The fixing belt 21 has an elastic layer and a releasing layer successively formed on a base material. The thickness of this fixing belt 21 is no greater than 1 mm.

The base material of the fixing belt 21 may be a metal material (e.g., nickel, stainless steel) or a resin material (e.g., polyimide) and have a thickness ranging from 30 to 50 μm.

The elastic layer of the fixing belt 21 may be a rubber material (e.g., silicone rubber, expandable silicone rubber, fluororubber) and have a thickness ranging from 100 to 300 μm. By providing this elastic layer, fine bumps and indentations can be prevented from being formed on the surface of the fixing belt 21 at the nipping portion, that is, the output image can be prevented from having a so-called orange peel surface, and heat can be uniformly transmitted to the toner image formed on the recording medium P.

The releasing layer of the fixing belt 21 may be a material such as PFA (4-fluoroethylene perfluoroalkylvinylether copolymer resin), PTFE (4-fluoroethylene resin), polyimide, polyether imide, or PES (polyethersulfide) and have a thickness ranging from 10 to 50 μm. The releasing layer ensures the releasing property (peeling property) with respect to toner T (toner image).

The fixing belt 21 may have a diameter ranging from 15-120 mm. In this embodiment of the present invention, the fixing belt 21 has a diameter of 30 mm.

The heater (heat source) 25, the heating member 22, the reinforcing part 23, and the heat insulating member 27 are fixed (mounted) to an inner part (inner peripheral surface) of the fixing belt 21. The fixing belt 21 is pressed against the pressure roller 31 by the heating member 22 being reinforced (supported) by the reinforcing part 23, to thereby provide a nipping part between the fixing belt 21 and the pressure roller 31.

The heat insulating member 27 is positioned between the reinforcing member 23 and the heating member 22. Thereby, the heat of the heating member 22 can be prevented from transferring to the reinforcing member 23. Thus, reduction of heating efficiency of the heating member 22 can be prevented. The heat insulating member 27 is formed of a heat resistant material having a high heat insulating property. For example, a rubber material, a resin material, a felt material, or a ceramic material may be used for the heat insulating member 27.

The heating member 22 is mounted on the fixing belt 21 in a manner facing the inner peripheral surface of the fixing belt 21. By having the heating member 22 abut the pressure roller 31 via the fixing belt 21, the nipping part is created between the fixing belt 21 and the pressure roller 31. As shown in FIG. 3, a side plate 43 of the fixing apparatus 20 is fixed to each end of the heating member 22 in its width direction for supporting the heating member 22.

The heating member 22 is formed in a manner so that the part corresponding to the nipping part is flat. That is, the heating member 22 is formed so that a face corresponding to the nipping part (face of the heating member that faces the pressure roller 31) is flat. The face corresponding to the nipping part becomes substantially parallel to the plane (image surface) of the recording medium P. This increases contact between the fixing belt 21 and the recording medium P, to thereby improve the fixing property of the fixing belt 21. Since the curvature of the fixing belt 21 becomes larger toward the exit of the nipping part, the recording medium P conveyed out from the nipping part can easily separate from the fixing belt 21.

In this embodiment of the present invention, although the cross section of the heating member 22 has a substantially round shape, the cross section may have a polygon shape. Furthermore, the heating member 22 may also have slits formed in its peripheral surface.

Furthermore, although the part of the heating member 22 corresponding to the nipping part has a flat shape according to this embodiment of the present invention, it may have a recessed shape. That is, the face of the heating member 22 facing the pressure roller 31 may be shaped to conform to the curvature of the pressure roller 31. Thus, the recording medium P can be conveyed out from the nipping part in a manner conforming to the curvature of the pressure roller 31. This reduces the difficulty of separating the recording medium P where the recording medium P is attracted to the fixing belt 21 after a fixing step.

In this embodiment of the present invention, the reinforcing member 23 serving to reinforce the strength of the part of the heating member 11 corresponding to the nipping part is mounted on the inner peripheral surface of the fixing belt 21. As shown in FIG. 3, the reinforcing member 23 has a length that is substantially the same as that of the heating member 22 with respect to the axial direction. The side plates 43 of the fixing apparatus 20 are also fixed one to each end of the reinforcing member 23 in its axial direction. By having the reinforcing member 23 abut the pressure roller 31 via the heating member 22 and the fixing belt 21, the heating member 22 can be prevented from being deformed by the pressure applied from the pressure roller 31 at the nipping part.

Without the reinforcing member 23, the heating member 22 may be bent by the pressure applied by the pressure roller 31. That is, the pressure applied between both ends of the heating member 22 may cause the center part of the heating member 22 to bend. This liability is particularly significant in a case where the heating member 22 is thinly formed for improving heating efficiency of the fixing belt 21. Accordingly, since the reinforcing member 23 is provided at a predetermined position for preventing deformation of the heating member 22, the bending of the heating member 22 can be relieved even in a case where the heating member 22 is formed thin. This prevents the surface of the inner peripheral surface of the fixing belt 21 from being strenuously rubbed against due to the bending of the heating member 22 and prevents an increase of driving torque of the fixing belt 21 due to the bending of the heating member 22.

In order to satisfy the above-described function of the reinforcing member 23, it is preferable to form the reinforcing member 23 with a metal material having high mechanical strength (e.g., stainless steel, iron). By forming the reinforcing member 23 with a horizontally elongated cross section along the pressure applying direction of the pressure roller 31, the section modulus of the reinforcing member 23 can be increased, to thereby further increase the mechanical strength of the reinforcing member 23.

Furthermore, a heat insulating member may be entirely or partially provided on a surface of the reinforcing member 23 facing the heater 25. Furthermore, the reinforcing member 23 may be subject to a mirror surface finishing process. Thereby, the radiant heat directed toward the reinforcing member 23 from the heater 25 (the heat heating the reinforcing member 23) can also be used for heating the heating member 22. Thus, the heating efficiency of the fixing belt 21 (heating member 22) can be further improved.

The heater 25 serving as a heating source may be a halogen heater or a carbon heater. The side plates 43 of the fixing apparatus 20 are also fixed one to each end of the heater 25 in its axial direction of FIG. 3. The output of the heater 25 is controlled by a power supply part of the main body 100 of the image forming apparatus 1, so that radiant heat of the heater 25 heats the heating member 22. This allows the heating member 22 to heat the entire surface of the fixing belt 21 and enables the heated surface to apply heat to the toner T on the recording medium P.

The output of the heater 25 is controlled in accordance with the surface temperature of the fixing belt 21 detected by the temperature sensor 40. By controlling the output of the heater 25, the temperature (fixing temperature) of the fixing belt 21 can be controlled to be a desired temperature.

As shown in FIG. 2, the heating member 22 is mounted (fixed) to the fixing belt 21 in a manner facing the inner peripheral surface of the fixing belt 21 including the part corresponding to the nipping part. In this condition, the heating member 22, which is heated by the radiant heat of the heater 25, transfers heat to the fixing belt 21. The heating member 22 may be formed of a heat conducting metal material (e.g., aluminum, iron, stainless steel).

With the fixing apparatus 20 according to an embodiment of the present invention, since the fixing belt 21 is heated substantially entirely with respect to its periphery by the heating member 22, the fixing belt 21 can be sufficiently heated and prevent poor fixing results even in a case of increasing the operating speed of the image forming apparatus 1. That is, since the fixing belt 21 can provide sufficient heating with a relatively simple configuration, size reduction can be achieved together with reducing the above-described warm-up time or first print time.

Next, a method of manufacturing the heating member 22 according to an embodiment of the present invention is described with reference to FIG. 4.

It is preferable that the gap 6 (space between the fixing belt 21 and the heating member 22 except the nipping part) be greater than 0 mm but equal to or less than 1 mm ($0\ \text{mm}<\delta\leqq 1\ \text{mm}$). This reduces the area of sliding contact between the heating member 22 and the fixing member 21, to thereby reduce the wear rate of the fixing belt 21. This also prevents heating efficiency of the fixing belt 21 from being reduced by separation of the heating member 22 and the fixing belt 21. Furthermore, by positioning the heating member 22 close to the fixing belt 21, the fixing belt 21 having a flexible property can maintain a relatively round shape. Wear or damage due to deformation of the fixing belt 21 can be prevented.

Furthermore, in order to reduce the wear of the fixing belt 21 due to the sliding contact between the heating member 22 and the fixing belt 21, the sliding contacting surface of the heating member 22 may be formed of a material having a low frictional coefficient. Furthermore, a coat of a lubricant (e.g., silicone oil, fluoro-grease) may be applied between the heating member 22 and the fixing belt 21.

As shown in FIG. 2, the pressure roller (pressing member) 31 according to an embodiment of the present invention has a diameter of 30 mm and includes an elastic layer 33 formed on a hollow cored bar 32. The elastic layer 33 may be formed of, for example, silicone rubber, expandable silicone rubber, or fluororubber. Furthermore, a thin releasing layer formed of, for example, PFA or PTFA may be provided on the surface of the elastic layer 33. The pressure roller 31 abuts the fixing belt 21, to thereby provide a desired nipping part between the pressure roller 31 and the fixing belt 21. As shown in FIG. 3, a gear 45, which meshes with a driving gear of a driving mechanism (not shown), is mounted on the pressure roller 31. Accordingly, the gear 45 is driven to rotate the pressure roller 31 in a clockwise direction (arrow direction shown in FIG. 2). Furthermore, the side plates 43 of the fixing apparatus 20 are also fixed one to each end of the pressure roller 31 in its axial direction via corresponding bearings 42. A heating source such a halogen heater may be provided inside the pressure roller 31.

In a case where the elastic layer 33 of the pressure roller 31 is formed with a sponge-like material (e.g., expandable silicone rubber), the pressure applied to a part of the fixing belt 21 corresponding to the nipping part can be reduced, to thereby reduce bending of the heating member 22. Furthermore, the heat insulating property of the pressure roller 31 can be improved to prevent the heat of the fixing belt 21 being transferred to the pressure roller 31. Thereby, heating efficiency of the fixing belt 21 can be improved.

Although the fixing belt 21 is formed with substantially the same diameter as that of the pressure roller 31 in the above-described embodiment of the present invention, the fixing belt 21 may be formed with a diameter smaller than that of the pressure roller 31. In such a case, since the curvature of the part of the fixing belt 21 corresponding to the nipping part becomes smaller than the curvature of the pressure roller 31, the recording medium P conveyed out from the nipping part can be more easily separated from the fixing belt 21.

Next, an exemplary operation of the above-described fixing apparatus 20 is described.

First, when a power switch of the main body 100 of the image forming apparatus 1 is turned on, power is supplied to the heater 25 and rotation (rotated in an arrow direction shown in FIG. 2) of the pressure roller 31 is started. Thereby, the fixing belt 21 is driven (rotated) in accordance with the frictional force generated between the pressure roller 31 and the fixing belt 21.

Then, the recording medium P is conveyed from the sheet feeding portion 12 to the position of the second transfer roller 89. At this position, unfixed color toner images T are transferred onto the recording medium P. The recording medium P having the unfixed color toner images T transferred thereon is guided in direction Y10 shown in FIG. 2 by a guiding plate (not shown) and introduced into the nipping part between the fixing belt 21 and the pressure roller 31 that are in pressing contact with each other.

Accordingly, the toner images T of the recording medium P are fixed onto the surface of the recording medium P by the heat applied from the fixing belt 21 (heated by the heating member 22 (heater 25)) and the pressure applied from the heating member 22 (supported by the reinforcing member 23) and the pressure roller 31. Then, the recording medium P conveyed out from the nipping part is further conveyed in direction Y11 shown in FIG. 2.

Next, a method of manufacturing the heating member 22 according to an embodiment of the present invention is described with reference to FIG. 4.

The heating member 22 is formed into a thin pipe-like shape by performing a bending process on a metal plate instead of performing a machining process.

More specifically, as shown in (A) of FIG. 4, a thin metal plate 120 is prepared by cutting off (cutting process) the metal plate 120 from a metal material. Then, as shown in (B) of FIG. 4, the metal plate 120 is bent by placing the metal plate 120 on a pressing machine and bending the metal plate 120 into a desired shape (bending process). More specifically, the metal plate 120 is bent in a substantially pipe-like shape so that end parts 120*a*, 120*b* (hereinafter also referred to as "both end portions 22*a*") of the metal plate 120 match each other and that a part 22*b* of the metal plate 120 (heating member 22) corresponding to the nipping part has a flat shape.

Accordingly, even in a case where a pipe-like heating member 22 is required to be formed as thin as possible for improving heating efficiency of the fixing belt 21, such heating member 22 can be formed precisely and inexpensively by performing the bending process on the metal plate 120.

More specifically, since the pipe-like heating member 22 is formed by the bending process, the nipping part can be formed at the same time of forming the heating member 22 into a cylindrical shape (pipe-like shape). Therefore, the cost of manufacturing the heating member 22 is relatively low.

In a case of forming the heating member 22 in a thin pipe-like shape, it is difficult to form the nipping part 22*b* by using a machining process. Particularly, in a case where the shape of the nipping part 22*b* is an adjustable curve, it is extremely difficult to form the nipping part by using a machining process. In this embodiment of the present invention, since the nipping part is formed by using performing a pressing process on the metal plate 120, the heating member 22 can be precisely and inexpensively formed even in a case where the shape of the nipping part 22*b* is an adjustable curve.

This advantage is significant in a case where the heating member 22 has a thickness no greater than 1 mm. In other words, in a case of forming a heating member having a thickness no greater than 1 mm by using a machining process, problems such as deformation caused by a chucking force applied from processing tools or bending during fabrication are likely to occur. In a case of forming a nipping part from a thin cylindrical metal pipe by using a machining process, it is difficult to attain a desired width for the nipping part (nip width) since allowance for the machining process cannot be obtained. Although there is a method of fabricating a pipe-like metal member by using an extruding process, it is difficult to form a pipe-like heating member having a thickness no greater than 1 mm.

Hence, since this embodiment of the present invention forms a pipe-like heating member 22 having a thickness no greater than 1 mm by preparing a metal plate 120 having a thickness no greater than 1 mm and bending the metal plate 120, the heating member 22 can be easily fabricated without any secondary processes.

The above-described advantage of the embodiment of the present invention is particularly significant in a case where a pipe-like heating member is formed by using aluminum or an aluminum alloy having a thickness no greater than 0.4 mm. In other words, it is difficult to fabricate such a pipe-like heating member with aluminum or an aluminum alloy having a thickness no greater than 0.4 mm by using a machining process. In contrast, the pipe-like heating member can be easily formed by performing a bending process on a metal plate 120 formed of aluminum or an aluminum alloy. It is to be noted that heating efficiency of the fixing belt 21 (heating member 22) can be further improved and warm-up time of the fixing apparatus 20 can be further shortened by using aluminum or an aluminum alloy having a thickness no greater than 0.4 mm as the heating member 22.

In this embodiment of the present invention, although there is a slight space created at the both end portions 22*a* after the heating member 22 is bent so that both end parts 120*a*, 120*b* of the metal plate 120 match each other, the heating member 22 may be bent in a manner that no space is created at the both end portions 22*a*. It is, however, to be noted that such a slight space created at the both ends portion 22*a* has hardly any effect on the heating efficiency of the heating member 22 with respect to the fixing belt 21.

It is to be noted that "facing an (the) inner peripheral surface of a (the) fixing member" includes "facing the entire inner peripheral surface of the fixing member" and "facing almost the entire inner peripheral surface of the fixing member". Therefore, even in a case where there is a slight space at the both end portions 22*a*, the heating member 22 is mounted on the fixing member 21 in a state "facing the inner peripheral surface of the fixing member".

Furthermore, in a case where the heating member 22 is bent in a manner so that no space is created at the both ends portion 22*a*, the both ends portion 22*a* (both end parts 120*a*, 120*b*) may be bonded, for example, by welding.

Although a joint may be created at the part of the both ends portion 22*a* by bonding both end parts 120*a* and 120*b* together, the creation of such a joint has hardly any effect on fixing toner images on the recording medium P when the joint even if the joint reaches the area of the nipping part since the heating member 22 is securely mounted (fixed) to the fixing apparatus 20 without any rotation. Furthermore, since the heating member 22 is securely mounted (fixed) on the fixing apparatus 20, no damage will be caused by lack of strength of the joint.

Furthermore, in a case where the heating member 22 is bent in a manner that no space is created at the both ends portion 22*a* and has the end parts 120*a* and the 120*b* bonded (e.g., welded) together, it is preferable that the heating member 22 be separated from the fixing belt 21 at the bonding part (welded part). This prevents the inner peripheral surface of the fixing belt 21 from contacting a part of the outer peripheral surface of the heating member 22 corresponding to the bonding part. For example, even in a case where a slight protrusion were created by the bonding process at the part of the outer peripheral surface of the heating member 22 corresponding to the bonding part, the inner peripheral surface of the fixing belt 21 would not be damaged by the bonding part.

Hence, in the above-described embodiment of the present invention, the heating member 22, which heats the fixing belt 21 in a manner facing the inner peripheral surface of the fixing belt 21, is fabricated by using a thin metal plate 120 and performing a bending process on the metal plate 120. Thereby, manufacturing cost can be reduced, heating efficiency of the fixing belt 21 can be improved, warm-up time or first print time can be reduced, and satisfactory fixing performance can be achieved even in a case where operation of the image forming apparatus is performed at high speed.

Although a pressure roller 31 is used as the pressing member in the above-described embodiment of the present invention, a pressure belt or a pressure pad may alternatively be used as the pressing member. Even in such a case where a pressure belt or a pressure pad is used, the same advantages of the above-described embodiment of the present invention can be attained.

Furthermore, although a fixing belt 21 having a layered configuration is used as the fixing member in the above-described embodiment of the present invention, an endless fixing film formed of polyimide, polyamide, fluororesin, or a metal material may be used as the fixing member. Even in such a case where an endless fixing film is used, the same advantages of the above-described embodiment of the present invention can be attained.

Second Embodiment

Figure 5:
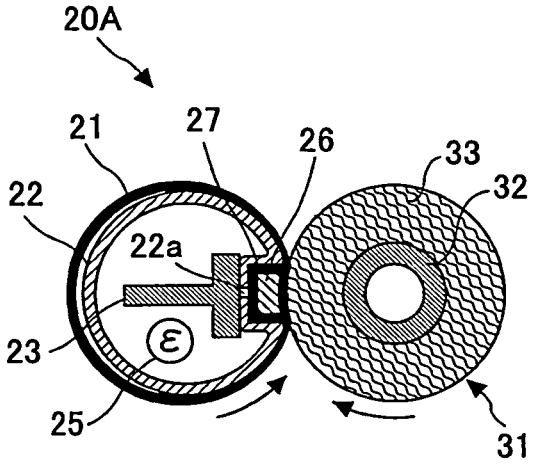
FIG. 5 is a schematic diagram showing a fixing apparatus according to a second embodiment of the present invention.

Next, a fixing apparatus 20A according to a second embodiment of the present invention is described with reference to FIG. 5. FIG. 5 basically corresponds to the configuration shown in FIG. 2. In the second embodiment of the present invention, like components and parts are denoted with like reference numerals as of the first embodiment of the present invention and are not further explained. The fixing apparatus 20A according to the second embodiment of the present invention mainly differs from the fixing apparatus 20 of the first embodiment in that a contacting member 26 serving as the nipping part is provided separately from the heating member 22 and that the nipping part is formed having a recessed shape.

As shown in FIG. 5, the fixing apparatus 20A according to the second embodiment of the present invention includes, for example, the fixing belt (fixing member) 21, the heating member 22, the reinforcing member 23, the heater (heating source) 25, and the pressure roller (pressing member) 31. The same as the heating member 22 of the first embodiment of the present invention, the heating member 22 according to the second embodiment of the present invention is also formed by performing a bending process on a metal plate.

The fixing apparatus 20A according to the second embodiment of the present invention has a contacting member (nipping portion member) 26 which is formed separately from the heating member 22. The contacting member 26 provides a nipping part by being fixed to contact the inner peripheral surface of the fixing belt 21 and contacting the pressure roller 31 via the fixing belt 21. The heating member 22 is formed in a manner facing the inner peripheral surface of the fixing belt 21 except at the nipping part. The part of the heating member 22 corresponding to the nipping part is formed in a manner holding the contacting member 26 via the heat insulating member 27.

The face of the contacting member 26 facing the pressure roller 31 has a recessed shape conforming to the curvature of the pressure roller 31. Thus, the recording medium P can be conveyed out from the nipping part in a manner conforming to the curvature of the pressure roller 31. This reduces the difficulty of separating the recording medium P where the recording medium P is attracted to the fixing belt 21.

The contacting member 26 is formed of a material having a substantial amount of rigidity (e.g., a metal having high rigidity, a ceramic), so that the contacting member 26 can be prevented from being bent by the pressure applied by the pressure roller 31.

Since the pipe-like heating member 22 can be formed thin by performing a bending process on a metal plate as described above, the warm-up time can be shortened. However, since the rigidity of the heating member 22 itself is low, the heating member 22 may bend or deform due to not being able to withstand the pressure applied from the pressure roller 31. Such bending or deformation of the pipe-like heating member 22 makes it difficult to obtain a desired nipping width. An insufficient nipping width leads to degradation of fixing performance. These problems can be prevented with this embodiment of the present invention since the nipping part is provided by using the rigid contacting member 26 formed separately from the thin heating member 22.

The contacting member 26 according to this embodiment of the present invention is detachably attached to the fixing apparatus 20A. More specifically, the contacting member 26 is detachably attached to the side plates 43 of the fixing apparatus 20A one at each of its ends in the axial direction by using a fastening member, for example, a screw or a snap tool. Thereby, even in a case where wear of the contacting member 26 due to sliding contact with the fixing belt 21 increases along with the passing of time, only the contacting member 26 needs to be replaced. This makes maintenance of the fixing apparatus 20A more efficient.

In order to reduce the wear of the fixing belt 21 that makes sliding contact with the contacting member 26, the contacting surface of the contacting member 26 may be formed of a material having a low frictional coefficient. Furthermore, a coat of lubricant may be applied between the contacting member 26 and the fixing belt 21. More specifically, a coating of, for example, Teflon (registered trademark), plating, DLC (Diamond-Like Carbon), or glass may be applied to the contacting surface of the contacting member 26. The surface roughness of the contacting surface of the contacting member 26 is preferred to be no greater than Rz=64 μm.

In this embodiment of the present invention, the heat insulating member 27 is provided between the contacting member 26 and the heating member 22. For example, a sponge rubber having a satisfactory heat insulating property or a porous ceramic material may be used as the material of the heat insulating member 27.

Since the contacting member 26 and the heating member 22 are positioned close to each other substantially throughout their entire peripheries, the fixing belt 21 can be uniformly heated at its periphery even when standing by for a heating process (standing by for a printing operation). Therefore, a printing operation can be immediately started after receiving a print request.

In using the above-described on-demand type fixing apparatus (as disclosed in Japanese Laid-Open Patent Application No. 2002-6656) where heat is applied to a pressure roller in a deformed condition at a nipping part in the heating standby state, degradation due to continuous heating may occur and shorten the longevity of the pressure roller or permanent compression may occur depending on the type of rubber of the pressure roller. The permanent compression increases as heat is applied to rubber in a deformed condition. When such permanent compression is generated, a part of the pressure roller may become recessed and prevent a desired nipping width from being obtained. This results in poor fixing performance and creation of noise during rotation of the pressure roller.

Meanwhile, since this embodiment of the present invention provides the heat insulating member 27 between the contacting member 26 and the heating member 22, the heat of the heating member 22 can be prevented from reaching the contacting member 26 during the heating standby state. Thus, heat can be prevented from being transferred to the pressure roller 31 in a deformed condition during the heating standby state. As a result, the above-described problems of the on-demand type fixing apparatus can be prevented.

Furthermore, in a case where a coat of lubricant (e.g., grease) is applied between the contacting member 26 and the fixing belt 21 for reducing the friction between the contacting member 26 and the fixing belt 21, the lubricant may be degraded by the high temperature of the nipping part. The degraded lubricant may cause slipping of the fixing belt 21.

However, since the heat insulating member 27 is provided between the contacting member 26 and the heating member 22, the heat of the heating member 22 can be prevented from reaching the lubricant at the nipping part. Therefore, lubricant can be prevented from being degraded by high temperature of the nipping part, to thereby prevent the above-described problems.

Furthermore, since the heat insulating member 27 is provided between the contacting member 26 and the heating member 22, the contacting member 26 can be protected (insulated) with respect to the heat. Thus, no heat is applied by conduction to the fixing belt 21 at the nipping part. The temperature of the recording medium P introduced into the nipping part becomes lower when the recording medium P is conveyed out from the nipping part. That is, at the exit of the nipping part, the temperature of the toner images on the recording medium P becomes lower, and the recording medium P can be separated from the fixing belt 21 where the adhesive strength of the toner with respect to the fixing belt 21 is low. Accordingly, the recording medium P can be prevented from clinging to the fixing belt 21. Thus, jamming can be prevented. In addition, toner can be prevented from solidifying on the fixing belt 21.

The both ends portion 22*a* (slight space), which is formed by the above-described bending process performed on the heating member 22, is provided in a position not facing the inner peripheral surface of the fixing belt 21 but a position facing the contacting member 26 (heat insulating member 27). Thereby, the heating member 22 faces the entire inner peripheral surface of the fixing belt 21 except at the position corresponding to the nipping part.

Hence, similar to the first embodiment of the present invention, in the above-described embodiment of the present invention, the heating member 22, which heats the fixing belt 21 in a manner facing the inner peripheral surface of the fixing belt 21, is fabricated by using a thin metal plate 120 and performing a bending process on the metal plate 120. Thereby, manufacturing cost can be reduced, heating efficiency of the fixing belt 21 can be improved, warm-up time or first print time can be reduced, and satisfactory fixing performance can be achieved even in a case where operation of the image forming apparatus is performed at high speed.

Third Embodiment

Next, a third embodiment of the present invention is described with reference to FIG. 6.

Figure 6:
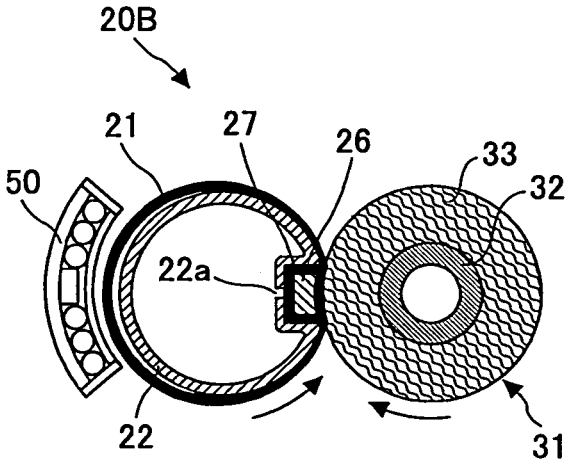
FIG. 6 is a schematic diagram showing a fixing apparatus according to a third embodiment of the present invention.

FIG. 6 is a schematic diagram showing a fixing belt 20B according to a third embodiment of the present invention. FIG. 6 basically corresponds to the configuration shown in FIG. 5. In the third embodiment of the present invention, like components and parts are denoted with like reference numerals as of the first and second embodiments of the present invention and are not further explained. The fixing apparatus 20B according to the third embodiment of the present invention mainly differs from the fixing apparatus 20A of the second embodiment in that the heating member 22 is heated by electromagnetic induction.

As shown in FIG. 6, the fixing apparatus 20B according to the third embodiment of the present invention includes, for example, the fixing belt (fixing member) 21, the heating member 22, the reinforcing member 23, the pressure roller (pressing member) 31, the contacting member 26, and the heat insulating member 27. The same as the heating member 22 of the first and second embodiments of the present invention, the heating member 22 according to the third embodiment of the present invention is also formed by performing a bending process on a metal plate.

The fixing apparatus 20B according to the third embodiment of the present invention has an induction heating part 50 instead of the heater (heating source) 25. Thus, the heating member 22 of the third embodiment of the present invention is heated by electromagnetic induction of the induction heating part 50 instead of being heated by the radiation heat of the heater 25.

The induction heating part 50 includes, for example, a magnetizing coil, a core, and a coil guide. The magnetizing coil has a thin bundle of litz wires extending in its width direction (vertical direction in FIG. 6) in a manner covering a part of the fixing belt 21. The coil guide is formed of, for example, a resin material having high heat resistance for supporting the magnetizing coil and the core. The core is a semi-cylindrical member formed of, for example, a ferromagnetic material (e.g., ferrite) having a dielectric constant ranging from approximately 1000-3000. A center core or a side core may be provided for forming an efficient magnetic flux to the heating member 22. The core is positioned in a manner facing the magnetizing coil extending in its width direction.

Next, an operation of the fixing apparatus 20B is described.

When the fixing belt 21 is rotated in the arrow direction of FIG. 6, the fixing belt 21 is heated at the area facing the induction heating part 50. More specifically, by applying a high frequency alternative current to the magnetizing coil, a line of magnetic force is bi-directionally generated back and forth at the periphery of the heating member 22. When the line of magnetic force is generated, an eddy current is created at the surface of the heating member 22. Thereby, joule heat is created by the electrical resistance of the heating member 22. Accordingly, the heating member 22 is heated by the joule heat generated by the induction heating part 50. Then, the heating member 22 heated by electromagnetic induction transfers its heat to the fixing belt 21.

In order to efficiently heat the heating member 22 by electromagnetic induction, it is preferable to provide the induction heating part 50 in a manner facing substantially the entire periphery of the heating member 22. The material of the heating member 22 may be, for example, nickel, stainless steel, iron, copper, cobalt, chrome, aluminum, gold, platinum, silver, tin, palladium, or alloys of these metals.

Hence, similar to the first and second embodiments of the present invention, the third embodiment of the present invention provides the heating member 22 which heats the fixing belt 21 in a manner facing the inner peripheral surface of the fixing belt 21 and is fabricated by using a thin metal plate 120 and performing a bending process on the metal plate 120. Thereby, manufacturing cost can be reduced, heating efficiency of the fixing belt 21 can be improved, warm-up time or first print time can be reduced, and satisfactory fixing performance can be achieved even in a case where operation of the image forming apparatus is performed at high speed.

Although the heating member 22 according to the third embodiment of the present invention is heated by electromagnetic induction, the heating member 22 may alternatively be heated by heat from a heating resistor. More specifically, a heating resistor may be provided in a manner partly or entirely contacting the inner peripheral surface of the heating member 22. The heating resistor is a heating member (e.g., ceramic heater) formed into a planar shape and has a power supply part connected to both ends thereof. When electric current is applied to the heating resistor, the heating resistor is heated by its own resistance. Then, the heat of the heating resistor is transferred to the heating member 22 contacting the heating resistor. Then, the heat of the heating member 22 is transferred to the fixing belt 21.

Alternatively, the heating member 22 itself may be a heating resistor. More specifically, the heating member 22 is formed into a thin heating resistor having a power supply part connected on both ends thereof. When electric current is applied to the heating member (heating resistor) 22, the heating member is heated by its own resistance. Then, the heat of the heating member 22 is transferred to the fixing belt 21.

It is to be noted that the above-described alternative examples of the heating member 22 are also fabricated by using a thin metal plate 120 and performing a bending process on the metal plate 120. In these alternative examples, fabricated by using a thin metal plate 120 and performing a bending process on the metal plate 120. Therefore, the above-described alternative examples of the heating member 22 can share the same advantages attained by the above-described embodiments of the present invention.

Fourth Embodiment

Figure 7:
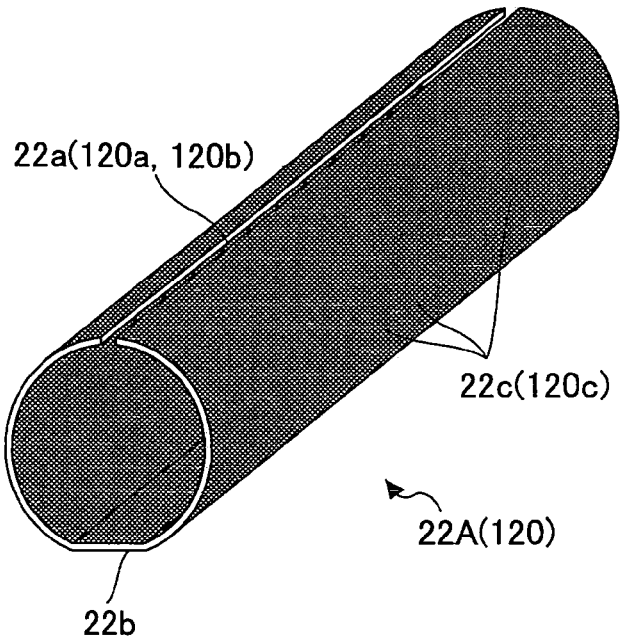
FIG. 7 is a perspective view showing a heating member of a fixing apparatus according to a fourth embodiment of the present invention.
Figure 8:
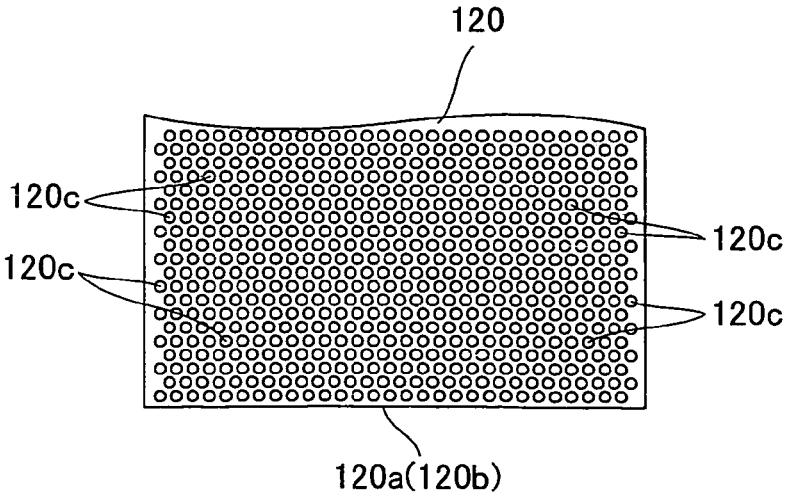
FIG. 8 is a plan view showing a metal plate prior to fabricating the heating member shown in FIG. 7.

Next, a fourth embodiment of the present invention is described with reference to FIGS. 7 and 8. FIG. 7 is a perspective view showing a heating member 22A according to the fourth embodiment of the present invention. FIG. 7 basically corresponds to the configuration shown in (B) of FIG. 4 of the first embodiment of the present invention. In the fourth embodiment of the present invention, like components and parts are denoted with like reference numerals as of the first, second, and third embodiments of the present invention and are not further explained. FIG. 8 is a plan view showing a metal plate 120 prior to being processed into the heating member 22 shown in FIG. 7. The heating member 22A according to the fourth embodiment of the present invention mainly differs from the heating member 22 of the first embodiment in that plural perforations are formed in the surface of the heating member 22A.

The same as the fixing apparatus 20 according to the first embodiment of the present invention, the fixing apparatus 20 according to the fourth embodiment of the present invention includes, for example, the fixing belt (fixing member) 21, the heating member 22, the pressure roller (pressing member) 31, the heater 25, the heat insulating member 27, and the reinforcing member 23.

As shown in FIG. 7, the heating member 22A according the fourth embodiment of the present invention has plural perforations 120*c* formed on the entire surface thereof. More specifically, as shown in FIG. 8, the heating member 22 is fabricated by performing a bending process on a metal plate having plural perforations 120 on its surface. In the fourth embodiment of the present invention, the 20B plural perforations 120*c* (22*c*) are round and have a diameter of 3 mm. It is to be noted that the shape, size, and the number of the plural perforations 120*c* (22*c*) are not to be limited to those described in the fourth embodiment of the present invention.

By providing plural perforations on the surface of the heating member 22, the light of the heater 25 can be directly transmitted to the fixing belt 21 via the perforations 22*c* (heat conduction). This improves warm-up performance of the fixing belt 21. That is, by providing perforations 22*c* in the heating member 22A having substantially the same thickness as the above-described embodiments of the present invention, the heating member 22A can further shorten the warm-up time of the fixing apparatus 20 while maintaining a substantial amount of rigidity. Furthermore, since a perforated metal plate 120 having perforations 22*c* formed beforehand is used for the bending process, there are hardly any constraints in fabricating the heating member 22.

In the fixing belt 21, although the above-described heat conduction causes little temperature difference at its area corresponding to the perforations 22*c* and its area other than the area corresponding to the perforations 22*c*, it is preferable to perform the heating while rotating the fixing belt 21 in order to further eliminate the temperature difference.

In this embodiment of using the heating member 22A having plural perforations 22*c*, it is preferable to avoid applying a coat of lubricant between the fixing belt 21 and the heating member 22A since the rapid heating of the inner peripheral surface of the fixing belt 21 may heat the lubricant beyond its heat resistant temperature and degrade the lubricant.

Furthermore, it is preferable to arrange the plural perforations so that temperature (heat) is evenly (uniformly) distributed in the width direction of the fixing belt 21.

In the fixing belt 21, the temperature at the areas corresponding to the perforations 22*c* increases rapidly by the direct heat energy transferred from the heating source 25. Meanwhile, the areas not corresponding to the perforations 22*c* are indirectly heated from the heat of the heating member 22A. Although the periphery of the fixing belt 21 is relatively evenly heated by rotating the fixing belt 21A, areas of the fixing belt 21 corresponding to large perforations may be heated faster than other areas. Therefore, it is preferable to form the perforations 22*c* with the same size and orderly align the perforations 22*c* in a diagonal direction (approximately 45 degrees in this example) in a lattice-like manner. This reduces uneven temperature of the fixing belt 21 in its width direction. In a case where temperature of the fixing belt 21 is unevenly distributed, hot offset occurs at the areas having high temperature and fixing failure occurs at the areas having low temperature.

Hence, similar to the above-described embodiments of the present invention, the fourth embodiment of the present invention provides the heating member 22A which heats the fixing belt 21 in a manner facing the inner peripheral surface of the fixing belt 21 and is fabricated by using a perforated thin metal plate 120 and performing a bending process on the metal plate 120. Thereby, manufacturing cost can be reduced, heating efficiency of the fixing belt 21 can be improved, warm-up time or first print time can be reduced, and satisfactory fixing performance can be achieved even in a case where operation of the image forming apparatus is performed at high speed.

Fifth Embodiment

Figure 9:
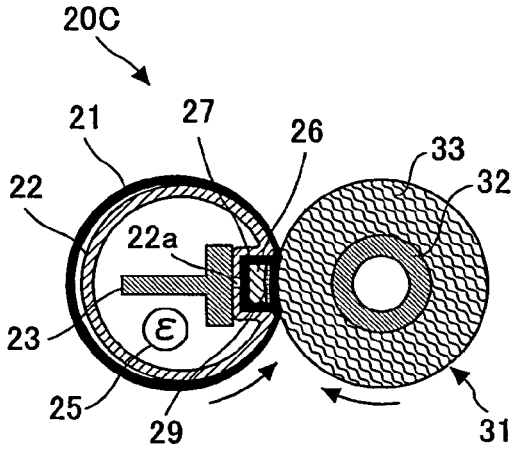
FIG. 9 is a schematic diagram showing a fixing apparatus according to a fifth embodiment of the present invention.
Figure 10:
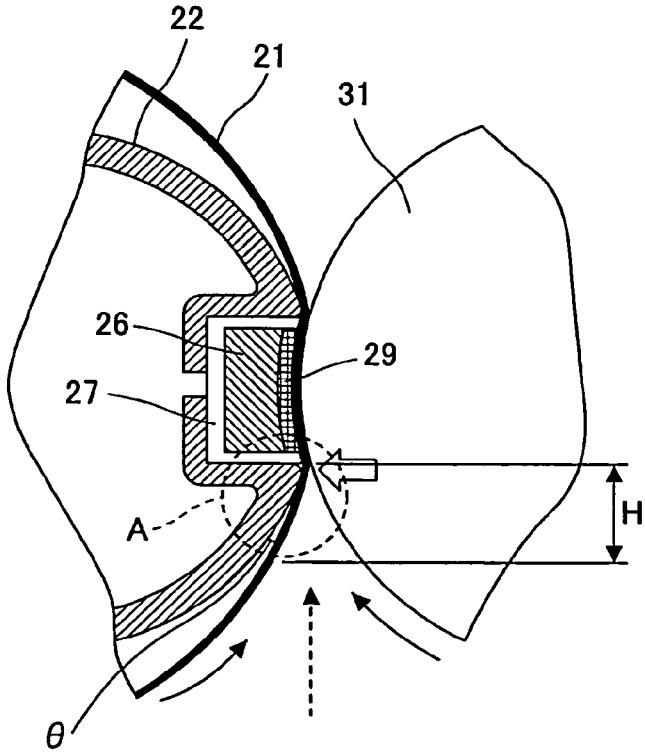
FIG. 10 is an enlarged view showing the vicinity of a nipping part of the fixing apparatus of FIG. 9 according to an embodiment of the present invention.
Figure 11:
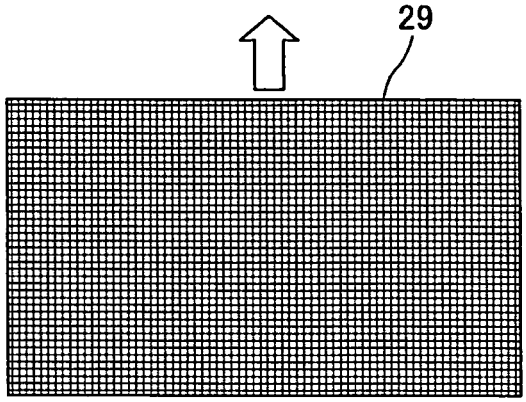
FIG. 11 is a plan view of a lubricant containing member according to an embodiment of the present invention.
Figure 12:
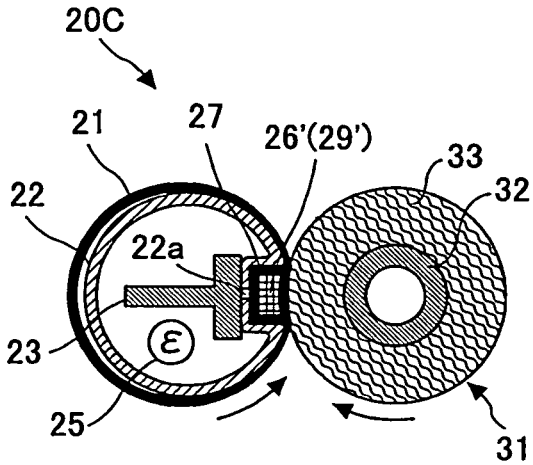
FIG. 12 is a schematic diagram showing another example of a fixing apparatus according to the fifth embodiment of the present invention.

Next, a fifth embodiment of the present invention is described with reference to FIGS. 9 through 12. FIG. 9 is a schematic diagram showing a fixing apparatus 20C according to the fifth embodiment of the present invention. FIG. 9 basically corresponds to the configuration of the second embodiment shown in FIG. 5. FIG. 10 is an enlarged view showing the vicinity of a nipping part of the fixing apparatus 20C of FIG. 9. FIG. 11 is a plan view showing a lubricant containing member. FIG. 12 is another example of a fixing apparatus 20D according to the fifth embodiment of the present invention. In the fifth embodiment of the present invention, like components and parts are denoted with like reference numerals as of the above-described first-fourth embodiments of the present invention and are not further explained. The fixing apparatus 20C according to the fifth embodiment of the present invention mainly differs from the above-described embodiments of fixing apparatus in that a porous lubricant containing member 29 is provided in the contacting member 26.

As shown in FIGS. 9 and 10, the fixing apparatus 20C according to the fifth embodiment of the present invention includes, for example, the fixing belt (fixing member) 21, the heating member 22, the pressure roller 31, the heater 25, the contacting member 26, the heat insulating member 27, and the reinforcing member 23. The same as the heating member of the above-described embodiments of the present invention, the heating member 22 according to the fifth embodiment of the present invention is also formed by performing a bending process on a metal plate.

In the fifth embodiment of the present invention, a porous lubricant containing member 29 is provided in the contacting member 26. More specifically, the lubricant containing member 29 is a mesh sheet material woven with fluorofiber. The lubricant containing member 29 contains a lubricant such as silicone oil or fluorogrease. The lubricant containing member 29 is positioned in a manner contacting the inner peripheral surface of the fixing belt 21 at the nipping part. In other words, the lubricant containing member 29 is disposed between the contacting member 26 and the fixing belt 21.

With this configuration, the lubricant contained in the lubricant containing member 29 is supplied to the inner peripheral surface of the fixing belt 21. Thereby, the sliding resistance between the contacting member 26 and the fixing belt 21 or the sliding contact between the heating member 22 and the fixing belt 21 are reduced. As a result, wear of these contacting members can be reduced. Furthermore, the lubricant containing member 29 is surrounded by the heat insulating member 27. Accordingly, the lubricant contained in the lubricant containing member 29 can be prevented from being vaporized or degraded by heat. Thus, even through the passing of time, the lubricant containing member 29 can consistently supply lubricant to the inner peripheral surface of the fixing belt 21. Furthermore, when the porous lubricant containing member 29 is positioned at the nipping part, the lubricant containing member 29 contracts and expands in correspondence with a contacting/separating operation between the fixing belt 21 and the pressure roller 31 performed by a contacting/separating mechanism (not shown). This promotes the supply (seeping) of the lubricant from the lubricant containing member 29.

In the fifth embodiment of the present invention, since the lubricant containing member 29 is provided at the nipping part in a manner covered by the heat insulating member 27, lubrication between the heating member 22 and the fixing belt 21 can be improved without affecting the heating of the fixing belt 21 by the heating member 22 compared to a case of providing the lubricant containing member 29 between the fixing belt 21 and the heating member 22 at an area other than the nipping part.

In the fifth embodiment of the present invention, when lubricant is supplied from the lubricant containing member 29 to the inner peripheral surface of the fixing belt 21, the rotation (movement) of the fixing belt 21 forms a circulation path of the lubricant between the gap between the fixing belt 21 and the heating member 22. That is, lubricant is allowed to flow throughout substantially the entire periphery of the fixing belt 21 at the gap between the fixing belt 21 and the heating member 22.

The circulation path of the lubricant is formed so that the gap between the fixing belt 21 and the heating member 22 tapers toward the nipping part from an inlet (entrance) side of the nipping part (the part indicated as "A" in FIG. 10). That is, as shown in FIG. 10, the gap between the fixing belt 21 and the heating member 22 is formed in a wedge-like shape at the inlet side of the nipping part.

The lubricant conveyed from the inlet side receives dynamic pressure (indicated with a white arrow in FIG. 10) owing to the wedge-like shape of the gap between the fixing belt 21 and the heating member 22. Thereby, a film of lubricant is formed on the sliding contacting surface of the fixing belt 21 and the heating member 22. The lubricant film serves to further reduce the sliding resistance between the fixing belt 21 and the heating member 22. Accordingly, durability of the fixing belt 21 and the heating member 22 can be improved.

Furthermore, the lubricant being applied with dynamic pressure is supplied to the porous lubricant containing member 29 provided at the nipping part. Then, the pressure applied to the supplied lubricant causes the lubricant in the lubricant containing member to evenly seep out to the inner peripheral surface of the fixing belt 21 at the nipping part. Accordingly, a lubricant film can be evenly formed on the part of the inner peripheral surface of the fixing belt 21 corresponding to the nipping part. As a result, durability against degradation of sliding property of the fixing belt 21 can be improved.

Since the viscosity of the lubricant on the surface of the metal heating member 22 will not increase when the heating member 22 is in a heated state, insufficient flow of lubricant at the nipping part due to loss of fluidity of the lubricant can be prevented. Therefore, it is preferable to heat the heating member 22 at a temperature substantially the same as that of the fixing belt 21.

Furthermore, in order to realize a satisfactory flow of lubricant in the circulation path, it is preferable to form the heating member 22 with a flat outer peripheral surface without any bumps and indentations.

Furthermore, it is preferable to form the circulation path in a manner that its wedge-like part is situated at an area H no less than 10 mm upstream from the inlet side of the nipping part and has an angle θ that is no greater than 2 degrees (see FIG. 10). This configuration of the circulation path ensures the above-described formation of the lubricant film. Thereby, durability of the fixing belt 21 and the heating member 22 can be improved.

The porous lubricant containing member 29 according to the fifth embodiment of the present invention is formed of, for example, a mesh sheet material woven with fluorofiber (see FIG. 11). This configuration of the lubricant containing member 29 can prevent the inner peripheral surface of the fixing belt 21 from being chipped and prevent the lubricant from drying out. Thus, compared to a case of using, for example, a PFA coated glass cloth or an aramid fiber impregnated in oil, the lubricant supplying property can be improved. More specifically, with this embodiment of the lubricant containing member 29 formed of a mesh sheet material woven with fluorofiber, the sliding property of the fixing belt 21 or the heating member 22 is not adversely affected even where the meshes of the lubricant containing member 29 are chipped when lubricant seeping from the mesh part of the lubricant containing member 29 is supplied to the fixing belt 21 since the fibers of the mesh part are formed of PFA or PTFE. Furthermore, since fluorofiber itself has a lubricating characteristic, a substantial lubricant property can be maintained even in a case where lubricant is dried out. Furthermore, the chipped particles of PFA or PTFE may circulate in the circulation path of the lubricant, to thereby improve lubrication between the fixing belt 21 and the heating member 22 (or the contacting member 26).

As shown in FIG. 11, the mesh sheet material used for the lubricant containing member 29 has intersecting fibers oriented in two directions in which the fibers oriented in one of the two directions are arranged in a rotating direction of the fixing belt 21 (direction indicated with a white arrow in FIG. 11). This configuration reduces the load resistance of the fixing belt 29 with respect to the lubricant containing member 29 and prevents slipping of the fixing belt 21.

Although the contacting member 26 and the lubricant containing member 29 are formed separately in the example of the fixing apparatus 20C shown in FIG. 9, the lubricant containing member 29' and the contacting member 26' may be integrally formed into a united body as shown in the example of FIG. 12.

More specifically, a material which has the functions of the lubricant containing member 29' may be used to form the contacting member 26'. That is, a porous material having a rigidity to withstand pressure applied from the pressure roller 31 while being able to contain (impregnate) a lubricant therein. The material used for the contacting member 26' is, for example, a heat resistant porous material such as an expanded silicon rubber material.

Although the contacting member 26 according to the fifth embodiment of the present invention has a rectangular cross section, the contacting member 26 may have a cross section of other shapes. For example, the cross section of the contacting member 26 may be shaped as a semicircle.

Hence, similar to the above-described embodiments of the present invention, in the fifth embodiment of the present invention, the heating member 22, which heats the fixing belt 21 in a manner facing the inner peripheral surface of the fixing belt 21, is fabricated by using a thin metal plate 120 and performing a bending process on the metal plate 120. Thereby, manufacturing cost can be reduced, heating efficiency of the fixing belt 21 can be improved, warm-up time or first print time can be reduced, and satisfactory fixing performance can be achieved even in a case where operation of the image forming apparatus is performed at high speed.

As described above, in the fixing apparatus according to an embodiment of the present invention, the space of the circulation path may include a wedge-like part, wherein the wedge-like part is situated at an area no less than 10 mm upstream from the inlet side of the nipping part and has an angle that is no greater than 2 degrees.

Furthermore, in the fixing apparatus according to an embodiment of the present invention, the lubricant containing member may include a mesh sheet material woven with fluorofiber, wherein the lubricant containing member contacts the inner peripheral surface of the fixing member at the nipping part.

Furthermore, in the fixing apparatus according to an embodiment of the present invention, the mesh sheet material may have intersecting fibers oriented in two directions, wherein the fibers oriented in one of the two directions are arranged in a rotating direction of the fixing member.

Furthermore, in the fixing apparatus according to an embodiment of the present invention, the lubricant containing member may be integrally formed with the contacting member.

Furthermore, the fixing apparatus according to an embodiment of the present invention may further include a heating source configured to heat the heating member with radiant heat.

Furthermore, the fixing apparatus according to an embodiment of the present invention may further include an induction heating part configured to heat the heating member with electromagnetic induction.

Furthermore, the fixing apparatus according to an embodiment of the present invention may further include a heating resistor configured to heat the heating member with heat generated from electric resistance.

Furthermore, in the fixing apparatus according to an embodiment of the present invention, the heating member may include a heating resistor.

Furthermore, in the fixing apparatus according to an embodiment of the present invention, the fixing member may include a fixing belt or a fixing film.

The present invention is not limited to the specifically disclosed embodiments, and variations and modifications may be made without departing from the scope of the present invention.

The present application is based on Japanese Priority Application Nos. 2007-135044 and 2008-044643 filed on May 22, 2007 and Feb. 26, 2008, respectively, with the Japanese Patent Office, the entire contents of which are hereby incorporated herein by reference.

What is claimed is:

1. A fixing apparatus comprising:

a flexible endless fixing member to move in a predetermined direction for heating and melting a toner image;

a heating member, that includes a substantially round cross section; and a pressing member to provide a nipping part by pressing into contact with the fixing member for conveying a recording medium, wherein the heating member is made of metal and has a recessed part at the nipping part, wherein the heating member is in a position to perform sliding contact at least at a part of an inner peripheral surface of the fixing member and to transfer heat to the fixing member except the nipping part, wherein the heating member includes end parts that are bonded together after a bending process, and wherein the heating member is separated from the fixing member at a part of the bonded end parts.

2. The fixing apparatus as claimed in claim 1, wherein the heating member has a thickness no greater than 1 mm.

3. The fixing apparatus as claimed in claim 2, wherein the heating member has a thickness no greater than 0.4 mm.

4. The fixing apparatus as claimed in claim 1, wherein the heating member includes a bended metal member having a plurality of perforations.

5. The fixing apparatus as claimed in claim 4, wherein the plurality of perforations are aligned so that temperature is uniformly distributed in a width direction of the fixing member.

6. The fixing apparatus as claimed in claim 1, further comprising:

a contacting member that is mounted to the inner peripheral surface of the fixing member at the nipping part and contacts the pressing member via the fixing member;

wherein the heating member faces the inner peripheral surface of the fixing member except at the nipping part.

7. The fixing apparatus as claimed in claim 6, wherein the contacting member is detachably attached to the fixing apparatus.

8. The fixing apparatus as claimed in claim 6, further comprising:

a heat insulating member provided between the contacting member and the heating member.

9. The fixing apparatus as claimed in claim 6, wherein the contacting member includes a lubricant containing member containing a lubricant and having a porous configuration.

10. The fixing apparatus as claimed in claim 9, further comprising:

a circulation path between a space between the fixing member and the heating member for circulating the lubricant supplied from the lubricant containing member;

wherein the space of the circulation path tapers toward the nipping part from an inlet side of the nipping part.

11. An image forming apparatus comprising:

the fixing apparatus as claimed in claim 1.

12. A heating member comprising:

a metal member, including a substantially round cross section, configured to be in a position to perform sliding contact at an inner peripheral surface of a fixing member and to transfer heat to the fixing member except a nipping part, wherein the metal member has a recessed part in an outer peripheral surface of the metal member, wherein the metal member includes end parts that are bonded together after the bending process, and wherein the metal member is separated from the fixing member at a part of the bonded end parts.

13. The heating member as claimed in claim 12, wherein the metal member has a thickness no greater than 1 mm.

14. The heating member as claimed in claim 12, wherein the metal member has a thickness no greater than 0.4 mm.

15. The heating member as claimed in claim 12, wherein the metal member has a plurality of perforations.

16. The fixing apparatus as claimed in claim 1, further comprising:

a contacting member that is located between the recessed part of the heating member and the fixing member at the nipping part.

17. An image forming apparatus comprising:

a flexible endless fixing member to move in a predetermined direction;

a pressing member that is in contact with the flexible endless fixing member and forms a nipping part with the flexible endless fixing member;

a metal heating member to be in a position to perform sliding contact and to transfer heat to at least a portion of an inner peripheral surface of the fixing member except the nipping part, the heating member having a recessed part at the nipping part; and a contacting member, disposed in the recessed part, the contacting member being in contact with the pressing member via the flexible endless fixing member at the nipping part, wherein the heating member includes end parts that are bonded together after the bending process, and wherein the heating member is separated from the fixing member at a part of the bonded end parts.

18. The image forming apparatus as claimed in claim 17, further comprising:

a reinforcing member located inside the heating member, the reinforcing member being in contact with an inner side of the recessed part of the heating member.

19. The image forming apparatus as claimed in claim 17, further comprising:

a heater that heats the heating member by radiant heat.

20. The image forming apparatus as claimed in claim 17, further comprising:

an induction heating part that heats the heating member by electromagnetic induction.

21. An image forming apparatus comprising:

a flexible endless fixing member to move in a predetermined direction;

a pressing member that is in contact with the flexible endless fixing member and forms a nipping part with the flexible endless fixing member;

a metal heating member to be in a position to perform sliding contact and to transfer heat to at least a portion of an inner peripheral surface of the flexible endless fixing member except the nipping part;

a contacting member, disposed inside the flexible endless fixing member, the contacting member being in contact with the pressing member via the flexible endless fixing member at the nipping part;

wherein the contacting member includes a mesh sheet material woven with fluorine fiber, the mesh sheet material is configured to perform sliding contact at the inner peripheral surface of the flexible endless fixing member and at the nipping part, the mesh sheet material includes fibers in which one of the fibers are oriented in the predetermined direction of the flexible endless fixing member, wherein the heating member includes end parts that are bonded together after the bending process, and wherein the heating member is separated from the fixing member at a part of the bonded end parts.

* * * * *

UNITED STATES PATENT AND TRADEMARK OFFICE

CERTIFICATE OF CORRECTION

PATENT NO. : 8,428,499 B2
APPLICATION NO. : 12/153632
DATED : April 23, 2013
INVENTOR(S) : Akira Shinshi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1084 days.

Signed and Sealed this
Sixteenth Day of December, 2014

Michelle K. Lee

Michelle K. Lee
*Deputy Director of the United States Patent and Trademark Office*